United States Patent [19]

Heinemann

[11] 4,081,351

[45] Mar. 28, 1978

[54] CONVERSION OF COAL INTO MOTOR FUEL

[75] Inventor: Heinz Heinemann, Princeton, N.J.

[73] Assignee: Mobil Oil Corporation, New York, N.Y.

[21] Appl. No.: 719,762

[22] Filed: Sep. 2, 1976

[51] Int. Cl.[2] ..... C10G 1/04; C10G 1/06; C10G 25/02; C10G 17/02

[52] U.S. Cl. ..... 208/8; 208/10; 208/90; 208/254 R

[58] Field of Search ..... 208/8, 10, 90, 254 R

[56] References Cited

U.S. PATENT DOCUMENTS

| | | | |
|---|---|---|---|
| 2,962,435 | 11/1960 | Fleck et al. | 208/254 R |
| 2,984,620 | 5/1961 | Fleck et al. | 208/254 R |
| 3,143,489 | 8/1964 | Gorin | 208/10 |
| 3,370,000 | 2/1968 | Gilbert et al. | 208/254 R |
| 3,719,587 | 3/1973 | Karchmer et al. | 208/254 R |
| 3,966,586 | 6/1976 | Owen et al. | 208/254 R |
| 4,008,145 | 2/1977 | Leas | 208/8 |

*Primary Examiner*—Delbert E. Gantz
*Assistant Examiner*—J. Thierstein
*Attorney, Agent, or Firm*—Charles A. Huggett; Carl D. Farnsworth

[57] ABSTRACT

This invention provides an improved process for deriving motor fuel from coal which involves the steps of solubilizing coal in a liquefaction solvent; separating undissolved solids from the liquefaction solution; fractionating the liquid phase by distillation; subjecting intermediate distillate fractions to denitrification treatment; and catalytic cracking of the resultant denitrified synthetic crude oil to produce premium grade gasoline.

3 Claims, 1 Drawing Figure

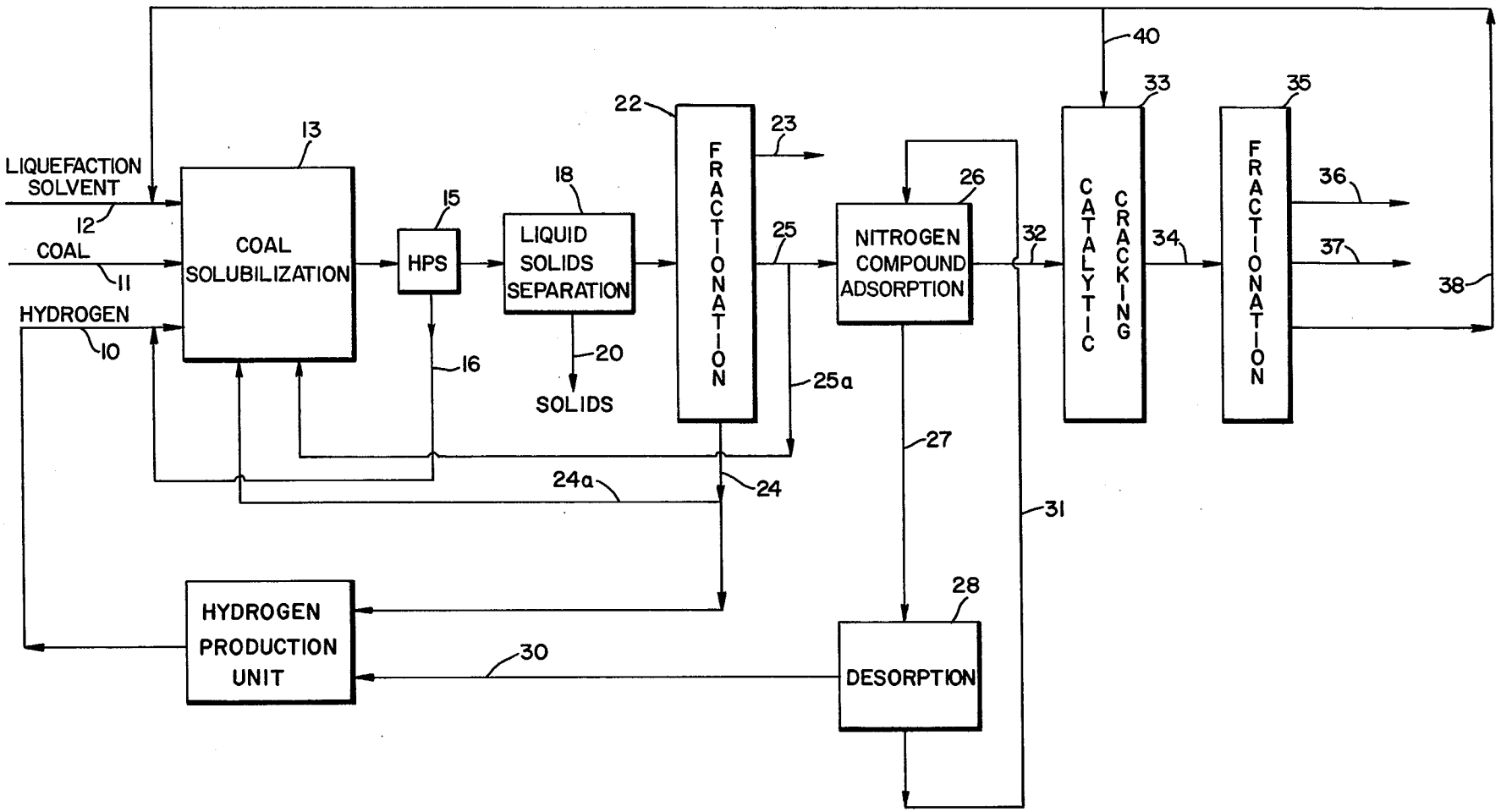
LIQUEFACTION SOLVENT
COAL
HYDROGEN
12
11
10
13
COAL SOLUBILIZATION
15
HPS
16
18
LIQUID SOLIDS SEPARATION
20
SOLIDS
22
FRACTIONATION
23
25
25a
24
24a
26
NITROGEN COMPOUND ADSORPTION
27
28
DESORPTION
30
31
32
33
CRACKING CATALYTIC
34
35
FRACTIONATION
36
37
38
40
HYDROGEN PRODUCTION UNIT

CONVERSION OF COAL INTO MOTOR FUEL

BACKGROUND OF THE INVENTION

Governments and industrial concerns on a priority basis are dedicating increased attention to alternatives to petroleum as sources for fuels and chemical intermediates, i.e., coal and wood. Substantial reserves of coal exist in highly industrialized countries, and wood is both plentiful and replenishable worldwide.

Since most current energy utilization technology requires liquid energy media, it has become an important research and development objective to provide innovative means to convert coal into liquid sources of potential energy.

It was recognized by early workers that coal can be liquified by controlled heating in the substantial absence of oxygen. The conversion products are a liquid and a char. Because of the new compelling economic factors, the technology of coal liquefaction and gasification has been expanding at an accelerated pace. Pioneer developments in the field are represented by Lurgi and Fischer-Tropsch technology. More recent advances in coal liquefaction are described in U.S. Pat. Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

The primary product of such coal liquefaction processes is a mixture of liquid and undissolved solids. The liquid is a solution of coal solubilization products dissolved in the liquefaction solvent. Most of the undissolved solids may be readily separated from the liquid by conventional solids-liquid separation processes such as filtration, centrifugation, sedimentation, hydroclones, and the like.

The prior art provides various methods for the separation of coal liquefaction liquids from undissolved solids. Illustrative of the prior art pertinent to such solids-liquids separation methods are U.S. Pat. Nos. 2,060,447; 2,631,982; 2,774,716; 2,871,181; 2,964,460; 2,989,458; 3,010,893; 3,018,241; 3,275,546; 3,519,553; 3,598,118; 3,607,716; 3,607,717; 3,607,718; 3,607,719; 3,635,814; 3,642,608; 3,687,837; 3,791,956; and Def. Publ. 700,485. One of the objectives of the prior art processes is maximum recovery of a coal liquefaction product which is substantially free of mineral matter. Other objectives include sulfur and oxygen removal.

The prior art provides various methods for upgrading coal liquefaction products. Conversion of solvent refined coal liquids into high grade motor fuels can be achieved by catalytic cracking and hydrocracking processes. Catalytic conversion of coal liquids has been hampered by the presence of nitrogen-containing organic derivatives in the coal liquids. Denitrification by catalytic means requires severe operating conditions, which results in high hydrogen consumption and a concomitant reduction of aromatic compounds.

There remains a pressing need for new technology for the conversion of coal into high value liquid carbonaceous products to complement and to enhance conventional petroleum derived energy applications. Further, there is a need for liquified coal products which qualify as premium gasolines which are high octane.

Accordingly, it is a main object of this invention to provide an improved method for converting solid carbonaceous materials into liquid derivatives having application as fuels.

It is another object of this invention to convert coal into a denitrified synthetic crude oil.

it is a further object of this invention to solubilize coal and upgrade the resultant liquid product for application as premium gasoline stock.

Other objects and advantages of the present invention shall become apparent from the accompanying description and examples.

DESCRIPTION OF THE INVENTION

One or more objects of the present invention are accomplished by the provision of an improved process for converting solid carbonaceous materials into motor fuel which comprises (1) solubilizing coal in a liquefaction solvent to form a homogeneous liquid phase; (2) separating the liquid phase from undissolved solids; (3) fractioning the liquid phase to provide distillate fractions; (4) subjecting the intermediate range distillate fractions to non-catalytic denitrification treatment to yield a denitrified synthetic crude oil; (5) introducing the synthetic crude oil into a catalytic cracking zone with or without hydrogen to produce motor fuel; and (6) fractionating the catalytic cracking zone effluent to separate motor fuel and other fractions.

The liquefaction solvent employed in step (1) of the process is a thermally stable, polycyclic aromatic and hydroaromatic mixture which results from one or more petroleum refining operations, or it is an indigenous coal fraction recycled from steps (3) and (6) of the invention process. The liquefaction solvent is a hydrogen-donor solvating medium, and nominally has a boiling point in the range between about 450° and 950° F. Materials boiling above 1000° F which are derived from the invention process may also be employed as a part of the liquefaction solvent.

The nominal properties of suitable liquefaction solvents are as follows:

| | |
|---|---|
| **Syntower Bottoms** | |
| Sulfur | 1.13% |
| Nitrogen | 450 ppm |
| Pour Point | 50° F |
| 5% Boiling Point | 640° F |
| 95% Point | 905° F |
| Conradson Carbon | 9.96 |
| **Clarified Slurry Oil** | |
| Sulfur | 1.04% |
| Nitrogen | 4400 ppm |
| Pour Point | 50° F |
| 5% Boiling Point | 630° F |
| 95% Point | 924° F |
| Conradson Carbon | 10.15 |
| **Heavy Cycle Oil** | |
| Sulfur | 1.12% |
| Nitrogen | 420 ppm |
| 5% Boiling Point | 373° F |
| 95% Point | 752° F |
| Conradson Carbon | 10.15 |

An FCC main column bottoms refinery fraction is a highly preferred liquefaction solvent for step (1) of the invention process. A typical FCC main column bottoms fraction contains a mixture of chemical constituents as represented in the following mass spectrometric analysis:

| Compounds | % Aromatics | % Naphthenic-Aromatics* |
|---|---|---|
| Alkyl Benzenes | 0.4 | |
| Naphthene-Benzenes | | 1.0 |

-continued

| Compounds | % Aromatics | % Naphthenic-Aromatics* |
|---|---|---|
| Dinaphthene-Benzenes | | 3.7 |
| Naphthalenes | 0.1 | |
| Acenaphthenes | | 7.4 |
| Fluorenes | | 10.1 |
| Phenanthrenes | 13.1 | |
| Naphthene-Phenanthrenes | | 11.0 |
| Pyrenes, Fluoranthenes | 20.5 | |
| Chrysenes | 10.4 | |
| Benzofluoranthenes | 6.9 | |
| Perylenes | 5.2 | |
| Benzothiophenes | 2.4 | |
| Dibenzothiophenes | 5.4 | |
| Naphthobenzothiophenes | | 2.4 |
| Total | 64.4 | 35.6 |

*Polycyclic compounds containing at least one fused alicyclic-aromatic ring structure, e.g., tetralin, hexahydrofluorene, octahydroanthracene, and the like.

This invention process is generally applicable for the liquefaction of bituminous and sub-bituminous types of coal. The typical analyses of various coals suitable for use in the invention process are as follows:

| | |
|---|---|
| **High Volatile A** | |
| Sulfur | 1.33% |
| Nitrogen | 1.63 |
| Oxygen | 7.79 |
| Carbon | 80.88 |
| Hydrogen | 5.33 |
| Ash | 2.77 |
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

Ball mills or other types of conventional apparatus may be employed for pulverizing coarse coal in the preparation of the comminuted feed coal for the liquefaction step. The crushing and grinding of the coal can be accomplished either in a dry state or in the presence of a liquid such as the liquefaction solvent being employed in the practice of the invention process. The average particle diameter of the feed coal is preferably below about 0.05 inches.

In step (1) of the invention process, the liquefaction solvent and comminuted coal are admixed to form a slurry. The slurry thus formed is heated at a temperature in the range between about 350° and 850° F, and preferably at a temperature between about 500° and 800° F.

The coal solubilization preferably is conducted in a closed system under moderate or high hydrogen pressure, with or without the presence of a hydrogenation catalyst. The hydrogen pressure is maintained in the range between about 500 and 5000 psi, and preferably in the range between about 1000 and 3000 psi.

Recently developed methods of coal hydrogenation are generally applicable for step (1) of the invention process. In a typical prior art process, coal hydrogenation is accomplished in the presence of a catalyst and a solvent under high hydrogen pressure at a temperature between about 650° and 750° F. Suitable catalysts include those containing metal oxides or metal sulfides of elements such as molybdenum, zinc, magnesium, tungsten, iron, nickel, chromium, vanadium, palladium, platinum, and the like. High temperature, sulfur-resistant catalysts such as molybdenum and tungsten sulfide are preferred (U.S. Pat. No. 3,932,266).

The coal solubilization step (1) of the process is normally conducted for a period of time between about 0.05 and 3 hours, and preferably for a period of time between about 0.2 and 1.5 hours until substantially all of the comminuted coal is dissolved.

The liquefaction solvent in step (1) is provided in a quantity between about 0.5 and 10 parts by weight per part by weight of the comminuted coal component. Normally, the preferred ratio will be in the range between about 1 and 5 parts by weight of liquefaction solvent per part by weight of coal.

At the conclusion of the coal solubilization step (1) of the process, the solution phase which is formed is passed into a separation zone where ash and other suspended undissolved solids are removed from the body of the liquid phase. The separation step (2) can be accomplished with conventional techniques such as filtration, centrifugation, sedimentation, hydroclones, and the like. It is advantageous to maintain the liquid phase at a temperature between about 200° and 500° F during the solids-liquid separation step.

The clarified liquid phase (i.e., the coal liquefaction effluent stream), thus recovered from the separation step (2) substantially free of suspended solids, in step (3) is passed into a distillation column wherein the solution is fractionated to provide distillate fractions. A light end distillate fraction boiling below about 400° F is recovered and removed from the system. A residual bottoms fraction which boils above about 1000° F is withdrawn and reserved for use as boiler fuel or as raw material for a hydrogen production plant. If desired, a portion of the residual bottoms fraction can be recycled to the step (1) coal solubilization reactor.

An intermediate distillate fraction boiling in the range between about 400° and about 1000° F is recovered from the step (3) distillation column and introduced into step (4) of the process. The same intermediate distillate can also be recycled to the step (1) coal solubilization reactor.

In step (4) the distillate hydrocarbon stream is subjected to a non-catalytic denitrification treatment to remove basic acyclic and heterocyclic nitrogen-containing organic constituents. The basic nitrogen compounds are mainly complex polycyclic structures which contain the following types of heteroatomic structures:

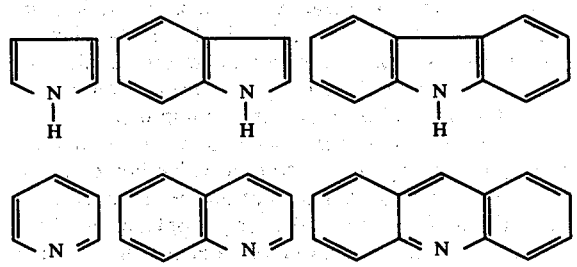

The nitrogen content of natural coal is variable, depending on the type and source of the hydrocarbonaceous material. The coal-refining procedure involved in the first three steps of the present invention process changes the chemical distribution of the coal derived product. As illustrated by the following analytical data, the solvent-refining of coal under hydrogen pressure lowers the sulfur content of the material, but it is ineffective for reducing the nitrogen content.

| | W. Kentucky 14 Coal | | |
|---|---|---|---|
| | Dry | Dry Ash Free | SRC Product |
| C | 72.98 | 79.0 | 87.6 |
| H | 5.12 | 5.9 | 4.8 |
| N | 1.33 | 1.4 | 2.0 |
| S | 3.06 | 3.3 | 0.8 |
| Ash | 8.48 | — | 0.7 |
| O | 9.03 | 9.8 | 3.4 |

Coal $C_{100}H_{89}N_{1.5}S_{1.5}O_9$
SRC $C_{100}H_{66}N_{1.9}S_{0.3}O_{2.9}$
7800 SCF $H_2$/ton coal
8.5 atoms H/100 C Typical cracking catalysts are deactivated by contact with acyclic and heterocyclic nitrogen-containing organic compounds under cracking conditions. The deactivation is severe, and regeneration by burning in air is required to restore catalytic activity. Highly poisonous nitrogen-containing organic compounds include quinaldine, quinoline, pyrrole, piperidine, aniline, pyridine, indole, α-naphthylamine, dicyclohexylamine, decylamine, and the like. The less basic organic compounds are not as poisonous to cracking catalysts as the more basic organic compounds.

The step (4) denitrificaton treatment is non-catalytic in nature, and effectively relies on the basicity of nitrogen heteroatoms in the coal constituents for selective removal of these moieties from the distillate hydrocarbon stream being treated in step (4) of the invention process.

In one method of denitrification treatment, the distillate hydrocarbon stream is contacted with gaseous hydrogen chloride to effect the formation of hydrochloride salts of the basic nitrogen compounds. Under the processing conditions, the hydrochloride salts separate from the hydrocarbon stream as an insoluble solid precipitate phase. Conventional solids-liquid separation methods can be employed to remove the precipitate phase from the hydrocarbon stream.

In another method of denitrification treatment, the distillate hydrocarbon stream is contacted with an aqueous solution of organic or inorganic acid. The solution acid concentration can vary from dilute (e.g., 10% toluenesulfonic acid) to highly concentrated (e.g., 85% sulfuric acid). A preferred method is to employ a mineral acid such as phosphoric acid in an aqueous solution concentration between about 30–80%, and countercurrently contact the hydrocarbon stream as a two-phase system maintained at a temperature between about 50° F and 200° F. In a continuous countercurrent system, the contact time can vary between about 30 seconds and 5 minutes. The aqueous acid phase containing the chemically extracted nitrogen compounds is passed into a recovery unit for separation of the inorganic acid and organic hydrocarbon components. The denitrified hydrocarbon stream, i,e., the synthetic crude oil, is water-washed and dried before it is passed into the step (5) catalytic cracking zone.

In another method of denitrification treatment, the distillate hydrocarbon stream is pumped through a bed of solid adsorbent which selectively adsorbs the basic nitrogen components to the substantial exclusion of the other organic constituents of the hydrocarbon stream. It is preferred that the adsorbent is "acidic" in adsorbent surface reactivity, e.g., synthetic silica-alumina gel composites. Other suitable adsorbents are those of an argillaceous nature, e.g., bentonite, halloysite, kaolin, montmorillonite, and the like, which have been subjected to prior acid treatment. Florosil is a highly preferred type of adsorbent for denitrification treatment.

The liquid hourly space velocity of the hydrocarbon stream through the adsorbent bed is not a critical factor, and the rate can vary so as to provide a contact time between about 0.5 and 5 minutes. The adsorbent bed is maintained at a temperature as low as possible, preferably between about 50° and 150° F. It is highly preferred that the nitrogen content of the hydrocarbon stream is reduced to less than about 0.1 weight percent, in order to eliminate or reduce substantially the detrimental effects of nitrogen compounds on catalysts in cracking and hydrocracking operations.

The spent adsorbent can be reactivated readily by heat treatment at a temperature between about 200° and 500° F. Another method of stripping the adsorbed basic nitrogen compounds is by contacting the spent adsorbent with a polar solvent such as methanol.

Desorbed organic compounds are recovered, and reserved for use as raw material for hydrogen production.

In the invention process, the denitrified synthetic crude oil above obtained is converted in step (5) to motor fuels and other light hydrocarbon products.

The synthetic crude oil is introduced into a step (5) catalytic cracking zone and subjected to cracking conditions which favor a high yield and conversion of the synthetic crude oil to relatively high octane gasoline. In a typical cracking process, the hydrocarbon oil feed is contacted with a catalyst in a fluid, fixed or moving bed catalytic conversion reactor. The cracking process may be effected with or without hydrogen, but is normally a high pressure hydrocracking operation.

A wide variety of hydrocarbon cracking catalysts are suitable for the purposes of step (5) of the invention process. There are now available new types of catalytic compositions which exhibit excellent activity for effecting catalytic conversion of organic compounds, especially cracking of petroleum hydrocarbons. These catalytic compositions are characterized by a low sodium content and comprise an intimate admixture of a porous matrix material and a crystalline aluminosilicate zeolite, the cations of which consist essentially, or primarily, of metal characterized by a substantial portion of rare earth metal, and a structure of rigid three-dimensional networks characterized by pores having a minimum cross-section of 4 to 15 Angstroms, preferably between 6 and 15 Angstrom units extending in three dimensions.

It is advantageous to intermix crystalline aluminosilicate catalysts with a material which will dilute and temper the activity thereof so that currently available cracking equipment and methods may be employed. In the preferred embodiments, there are utilized materials which do more than perform a passive role in serving as a diluent, surface extender or control for the highly active zeolite catalyst component. The highly active crystalline aluminosilicate zeolite catalysts are combined with a major proportion of a catalytically active material which, in such combination, will enhance the production of gasoline of higher octane values than are produced by cracking with such zeolitic catalysts alone, while concomitantly providing a composite catalyst composition which may be used at much higher space velocities than those suitable for the best prior catalysts, and which composite catalyst composition also has greatly superior properties of product selectivity and steam stability. Cracking may be effected in the presence of said composite catalyst composition utilizing currently available techniques including, for example, those wherein the catalyst is employed as a fluidized mass, fixed bed, or as a compact particle-form moving bed.

The crystalline aluminosilicates employed in preparation of catalysts may be either natural or synthetic zeolites. Representative of particularly preferred zeolites are the faujasites, including the synthetic materials such as Zeolite X described in U.S. Pat. No. 2,882,244; Zeolite Y described in U.S. Pat. No. 3,130,007; as well as other crystalline aluminosilicate zeolites having pore openings of between 6 and 15 Angstroms. These materials are essentially the dehydrated forms of crystalline hydrous siliceous zeolites containing varying quantities of alkali metal and aluminum, with or without other metals. The alkali metal atoms, silicon, aluminum and oxygen in these zeolites are arranged in the form of an aluminosilicate salt in a definite and consistent crystalline pattern. The structure contains a large number of small cavities interconnected by a number of still smaller holes or channels. These cavities and channels are uniform in size. The alkali metal aluminosilicate used in preparation of the present catalyst has a highly ordered crystalline structure characterized by pores having openings of uniform sizes within the range greater than 4 and less than 15 Angstroms, preferably between 6 and 15 Angstroms, the pore openings being sufficiently large to admit the molecules of the hydrocarbon charge desired to be converted. The preferred crystalline aluminosilicates will have a rigid three-dimensional network characterized by a system of cavities and interconnecting ports or pore openings, the cavities being connected with each other in three dimensions by pore openings or ports which have minimum diameters of greater than 6 Angstrom units and less than 15 Angstrom units. A specific typical example of such a structure is that of the mineral faujasite.

In a preferred embodiment, the material with which the aluminosilicate is composited is both porous and catalytically active in order to realize the fullest potential of the catalyst. The term "catalytically active" as used herein is intended to mean those materials which are capable of effecting at least 15 percent and preferably more than 20 percent conversion of a Mid-Continent gas oil having a boiling range of 450° to 950° F at a space velocity of 2 LHSV at a temperature of 900° F and substantially atmospheric pressure.

Representative active matrices which can be employed include preferably those silica-alumina catalysts known to have high octane number producing properties, e.g., silica-alumina gels, and certain raw clays, or raw clays which have been acid-treated. Other catalytically active matrix materials which may be used include inorganic oxides such as silica gel, alumina gel, and alumina-boria composites. Other gels suitable as matrices include those of silica-zirconia, silica-magnesia, silica-thoria, silica-rare earth oxide, silica-beryllia, silica-titania, as well as ternary combinations such as silica-alumina-thoria, silica-alumina-zirconia, silica-alumina-magnesia, and silica-magnesia-zirconia. Of the foregoing gels, silica is generally present as the major component, and the other oxides of metals are present in minor proportion. Siliceous hydrogels utilized herein may be prepared by any method well known in the art, such as, for example, hydrolysis of ethyl ortho silicate, acidification of an alkali metal silicate which may contain a compound of a metal, the oxide of which it is desired to cogel with silica, etc. The choice of porous matrix material will depend to some extent on the objectives sought. Thus, where a high yield of gasoline is desired, silica gel having sufficient inherent cracking activity to meet the above noted standard may be a preferred matrix. Where gasoline, in somewhat lower yield, but of high octane number is desired, silica-alumina is a preferred matrix. The preparation of this type of preferred cracking catalyst is more fully described in U.S. Pat. No. 3,210,267.

More recent advances in catalysts suitable for cracking of heavy hydrocarbon oils into motor fuels in accordance with the present invention process are described in U.S. Pat. Nos. 3,758,403; 3,769,202; 3,790,471; 3,791,964; 3,804,746; 3,830,725; 3,849,291; 3,886,060; 3,894,934; and 3,926,778.

Cracking can be conducted under catalytic cracking conditions employing a temperature within the approximate range of 700° to 1200° F and employing a pressure ranging from subatmospheric pressure up to several hundred atmospheres. The contact time of the oil with the catalyst is adjusted according to the conditions, the particular oil feed and the particular results desired to give a substantial amount of cracking to lower boiling products.

The hydrocarbon cracking step (5) of the present invention process can be conducted in both the "moving bed" and "fluid cracking" type of operation. In the "moving bed process" (e.g., Thermofor Catalytic Cracking or TCC) catalyst particles are used which are generally in the range of about 0.08 to 0.25 inch in diameter. Useful reaction conditions include temperatures above about 850° F, pressures from subatmospheric to approximately 3 atmospheres, catalyst to oil ratios of about 1.5–15 and liquid hourly space velocities of about 0.5 to 6.

In the "fluidized catalytic cracking" process (or FCC) catalyst particles are used which are generally in the range of 10 to 150 microns in diameter. The commercial FCC processes include one or both of two types of cracking zones, i.e. a dilute bed (or "riser") and a fluid (or dense) bed. Useful reaction conditions in fluid catalytic cracking include temperatures above 850° F, pressures from subatmospheric to 3 atmospheres, catalyst-to-oil ratios of 1 to 30, oil contact time less than about 12 to 15 seconds in the "riser," preferably less than about 6 seconds, wherein up to 100% of the desired conversion may take place in the "riser," and a catalyst residence (or contact) time of less than 15 minutes, preferably less than 10 minutes, in the fluidized (or dense) bed.

The effluent from the step (5) cracking operation is subjected to a separation procedure for removal of the suspended solid catalyst. Cyclone separators are a preferred means.

The hydrocarbon phase which is obtained from this separation procedure is passed into a step (6) product fractionator wherein the product stream is separated into heavy oil recycle fractions, middle gasoline fractions, and light end fractions. All or a portion of the heavy oil fractions can be recycled to the coal solubilization step (1) of the process, or all or a portion of the heavy oil fractions can be recycled to the hydrocarbon cracking step (5) of the process.

The separated catalyst can be collected as a dense fluid bed of catalyst particles. The catalyst can be mixed with hot regenerated catalyst and passed through a catalyst stripping zone in accordance with the procedures described in U.S. Pat. No. 3,886,060.

With reference to the FIGURE, the drawing is a schematic flow diagram illustrative of an embodiment of the present invention process.

As represented in the drawing, hydrogen is fed through line 10, coal through line 11, and liquefaction solvent through line 12 into coal solubilization reactor 13. The reactor contains an upflow expanded bed catalyst such as spherical cobalt molybdate in sulfided form. Typically, the liquid hourly space velocity of feed, i.e., the liquid volume of feed per volume of catalyst is between about 0.25 and 4. In general, an operating temperature of 800° F, an operating pressure of 1400 psi, and a hydrogen feed rate of 25 SCF/lb coal are maintained. The liquefaction solvent comprises about 70 weight percent of the slurry mixture.

The coal substantially dissolves to form a solution phase in which there is suspended ash and undissolved coal solids. This two-phase mixture is passed through line 14 into high pressure separator 15. Hydrogen is separated and recycled through line 16 to reactor 13. The liquid phase and suspended solids are withdrawn from separator 15 through line 17, and entered into solids removal zone 18. The solids removal can be effected by hydroclones at a temperature between about 200° and 500° F, or by passage through a ceramic filter system, or by gravity settling.

Solids are removed from separator 18 through line 20, and the liquid phase is passed through line 21 into distillation unit 22. Light end distillate boiling below about 400° F is recovered from unit 22 through line 23. A bottoms fraction having a boiling range above about 1000° F is removed from distillation unit 22 through line 24 and reserved for hydrogen production, or is recycled through line **24*a* to coal solubilization reactor 13. Middle and heavy distillate fractions boiling in the range between about 400° and 1000° F are passed through line 25 into an adsorbent bed system 26. Part or all of the stream in line 25 can also be diverted through line 25*a* to coal solubilization reactor 13**.

The solid adsorbent, e.g., Florosil, in bed system 26, is maintained at a temperature of about 100°–150° F. The liquid hourly space velocity of the liquid phase is at a rate which provides a contact time of about 1–3 minutes. The basic nitrogen-containing acyclic and heterocyclic organic compounds are selectively adsorbed by bed system 26. Spent adsorbent is removed from bed system 26 through line 27 and entered into desorption zone 28. Desorption is achieved by heat treating the spent adsorbent at a temperature of about 400°–500° F. Desorbed nitrogeneous organic derivatives are removed through line 30 and reserved for hydrogen production. Reactivated adsorbent is recycled through line 31 to bed system 26.

Denitrified hydrocarbon effluent (i.e., synthetic crude oil) from adsorbent bed system 26 is passed through 32 and entered into catalytic cracking reactor 33. The upward flow of hydrocarbons in FCC reactor 33 is adjusted to maintain a fluidized bed of finely divided catalyst. A zeolite is employed, and the cracking operation is conducted at a temperature of 950°–975° F, a weight hourly space velocity of 11 and a catalyst-to-oil ratio of 8.

An effluent stream is withdrawn from reactor 33 and passed through line 34 into a distillation unit 35. A gas and light ends stream is recovered from unit 35 via line 36. Gasoline fractions are recovered through line 37. Heavy oil fractions boiling between about 450° and 1100° F and recycled through line 38 to coal solubilization reactor 13, and/or through line 40 to FCC reactor 33. .

When the reactor 33 is a thermofor catalytic cracking (TCC) operation, then the reactor contains catalyst pellets of one-sixteenth inch diameter which move downwardly through the reactor as a compact bed. The hydrocarbon oil flow is concurrent with the catalyst flow. The reactor conditions are a temperature of 875°–925° F, a liquid hourly space velocity of 2, and a catalyst-to-oil ratio of 5.

The foregoing is a general discussion of the improved methods and systems of the present invention process for the conversion of coal into motor fuel, and specific exemplary data are provided in support thereof. Various modifications can be devised in view of the foregoing disclosure within the scope of the invention.

What is claimed is:

1. A process for converting coal into liquid fuel which consists of the steps (1) solubilizing coal in a liquefaction solvent to form a homogeneous liquid phase, wherein said liquefaction solvent is a thermally stable polycyclic aromatic and hydroaromatic mixture which results from one or more petroleum refining operations; (2) separating the liquid phase from undissolved solids; (3) fractioning the liquid phase to provide distillate fractions; (4) subjecting the intermediate range of distillate fractions having a boiling point in the range between about 400° and 1000° F to non-catalytic denitrification treatment to yield a denitrified synthetic crude oil having a nitrogen content of less that about 0.1 weight percent; and (5) introducing the synthetic crude oil into a catalytic cracking zone to produce motor fuel.

2. A process in accordance with claim 1 wherein the step (4) denitrification treatment is accomplished by passage of the intermediate distillate through a bed of solid adsorbent which has an acidic adsorbent surface reactivity.

3. A process in accordance with claim 1 wherein the step (4) denitrification treatment is accomplished by treatment of the intermediate distillate with gaseous hydrogen chloride to precipitate basic nitrogen compounds as hydrochloride salts.

* * * * *